United States Patent [19]

Nowak

[11] 4,250,805

[45] Feb. 17, 1981

[54] HIGH-SPEED HYDRAULIC PRESS

[75] Inventor: Edmund Nowak, Warsaw, Poland

[73] Assignee: Zaklad Nr 2 Hydomat Fabryka Pras Automatycznych Ponar-Plasomat, Warsaw, Poland

[21] Appl. No.: 64,797

[22] Filed: Aug. 8, 1979

[30] Foreign Application Priority Data

Aug. 25, 1978 [PL] Poland ..... 209231

[51] Int. Cl.[3] ..... B30B 1/32

[52] U.S. Cl. ..... 100/269 B; 100/257

[58] Field of Search ..... 100/257, 269 B, 269 R

[56] References Cited

U.S. PATENT DOCUMENTS

| | | | |
|---|---|---|---|
| 3,635,152 | 1/1972 | Olmsted | 100/269 B |
| 4,099,436 | 7/1978 | Beneteau | 100/269 B |
| 4,153,180 | 5/1979 | Fernique | 100/269 B |

FOREIGN PATENT DOCUMENTS 2504439 5/1976 Fed. Rep. of Germany .

*Primary Examiner*—Billy J. Wilhite

*Attorney, Agent, or Firm*—Haseltine and Lake

[57] ABSTRACT

A high-speed hydraulic press comprises a driving system including a cylinder having a sealed piston mounted slidably thereon, said piston being integral with a piston rod which is provided with a follow-up multiplicating sleeve having faces which form, on one side, at least one working chamber for rapid motion and, on the other side, a main working chamber for working motion of the press. The working chamber preferably is connected to a hydraulic supply system through a conduit fitted with a check valve enabling pressure multiplication in the chambers during the working motion of the piston. The follow-up sleeve preferably has a peripheral flange of which one face forms the main working chamber and is provided with at least one projection. The working chamber, as well as the main working chamber are preferably connected to one supply system.

7 Claims, 3 Drawing Figures

HIGH-SPEED HYDRAULIC PRESS

BACKGROUND OF THE INVENTION

This invention relates to hydraulic presses and more particularly to high-speed hydraulic presses.

The most simple hydraulic presses are those wherein both the approach of the working ram to the work piece, as well as its working motion are effected by systems supplying pressurized hydraulic medium to the hydraulic cylinder of the press. As a result, an approximately constant rate of travel of the ram and, consequently, a uniform pressure over the entire length of the stroke of the ram are obtained. The disadvantages of this system are that considerable power losses are caused by the existence of a large pressure force existing during the idle run of the ram, that is during the approach of the ram of the work piece and, at the same time, smaller speed of the system caused by a limited delivery of the hydraulic pump in the hydraulic supply circuit.

In another known hydraulic press, these disadvantages are eliminated by providing an additional hydraulic system for a rapid piston traverse in the initial stage of the motion corresponding to the approach of the ram, and, providing two hydraulic systems for feeding the main pressure chamber, namely, a suction system operating in the first stage of the motion corresponding to the approach movement of the ram and a system for 'supercharging' the chamber with a pressurized hydraulic medium in the working stage of the piston traverse. In a press having such hydraulic systems the speed of the ram approach motion is increased, the pressure force of this motion is reduced, and the pressure force of the working motion is increased. However, serious drawback of this press is aeration of its main pressure chamber observed in a case when the ram approach motion has been too rapid, which in practice restricts the speed of the press. Moreover, presses of this kind have complicated hydraulic systems with sophisticated controls, and many valves of which the suction valves with large flow rates have relatively long resetting times and thus restrict the speed of the press.

In another known press, the above mentioned drawbacks have been eliminated by providing two independent hydraulic systems for feeding the main pressure chamber, namely, a system with a high delivery and low pressure for feeding the chamber during the approach motion, as well as a high-pressure system for the working motion of the ram. Hydraulic presses of this kind can have considerably higher speeds than the above mentioned press. On the other hand, the above mentioned press has also some drawbacks, namely, it must have two independent hydraulic systems and a relatively sophisticated control system, the speed of the press being limited by the necessary time for resetting the system from one working mode to another.

SUMMARY OF THE INVENTION

The main object of this invention is to reduce or eliminate the above mentioned drawbacks and disadvantages of the high-speed hydraulic presses previously known by avoiding two independent hydraulic supply or driving systems, by simplifying the control system, and, simultaneously, ensuring an increased ram pressure force.

To this end, the present invention consists in a hydraulic press having a follow-up multiplication sleeve in the driving system of the press slidably mounted on the piston rod, the said sleeve forming, on one side, a working chamber with a small pressure area for the ram idle run/approach/ and, on the other side, a thrust surface of the main pressure chamber equal to the ram working area.

Preferably, both the chambers are supplied from one hydraulic supply system through suitable valves. By means of the invention, aeration observed in the presses utilizing suction and involving necessary resetting of separate supply or driving systems is eliminated or substantially reduced, and hydraulic presses constructed according to this invention can attain speeds which would be unattainable in the hydraulic presses so far used and known to the applicants. Moreover, the elimination of the separate supply or driving systems leads to a decreased power demand. Owing to this, presses constructed in accordance with the invention can attain delivery which is sufficiently high, yet consumes considerably less power.

Further, presses constructed according to the invention are of simple and dependable structure and have a prolonged useful life.

DESCRIPTION OF THE PREFERRED EMBODIMENT

Figure 1:
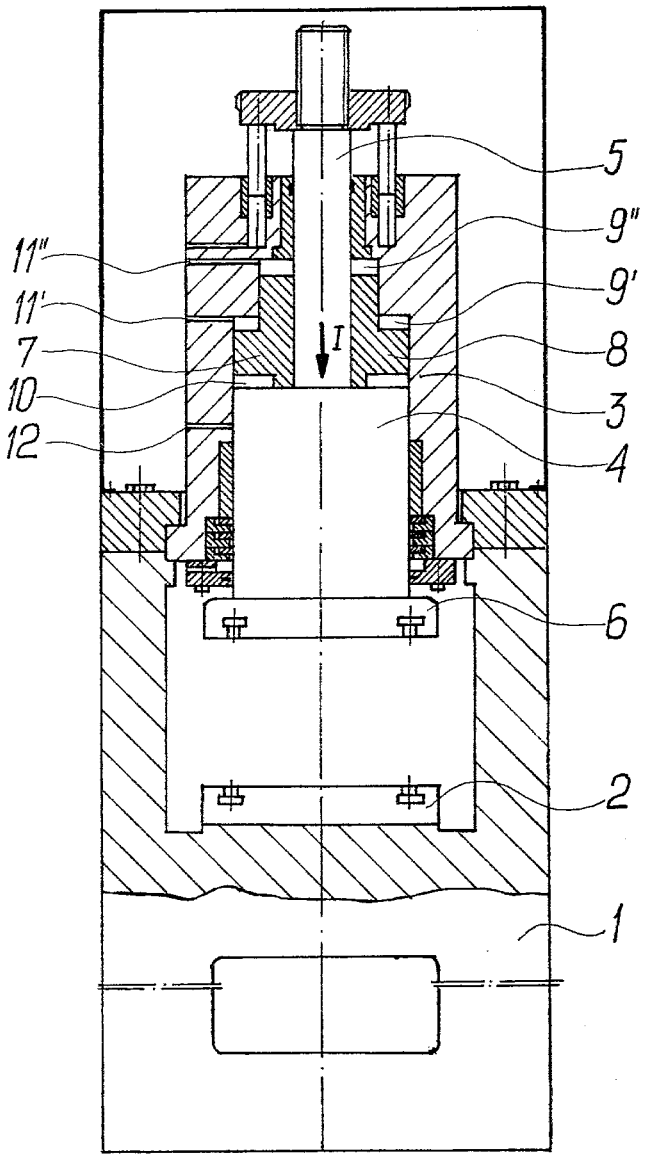
FIG. 1 is an axial section of a hydraulic press at the moment of beginning of ram approach motion.

The hydraulic press of the present invention comprises a frame 1 supporting a table 2 in its lower part and a driving system in its upper part.

The driving system includes a hydraulic cylinder 3, in which a ram 4 is slidably mounted. The ram has a ram or piston rod 5 and carries working table 6 which is moveable therewith. On the piston rod 5 there is slidably mounted a follow-up multiplication sleeve 7. The sleeve 7 has an annular peripheral flange 8, the sleeve with its flange 8 forming working chamber 9' or 9'' between the upper surface of the flange and a shoulder on the cylinder and between the upper end of the sleeve and the upper end of the cylinder, respectively.

Figure 2:
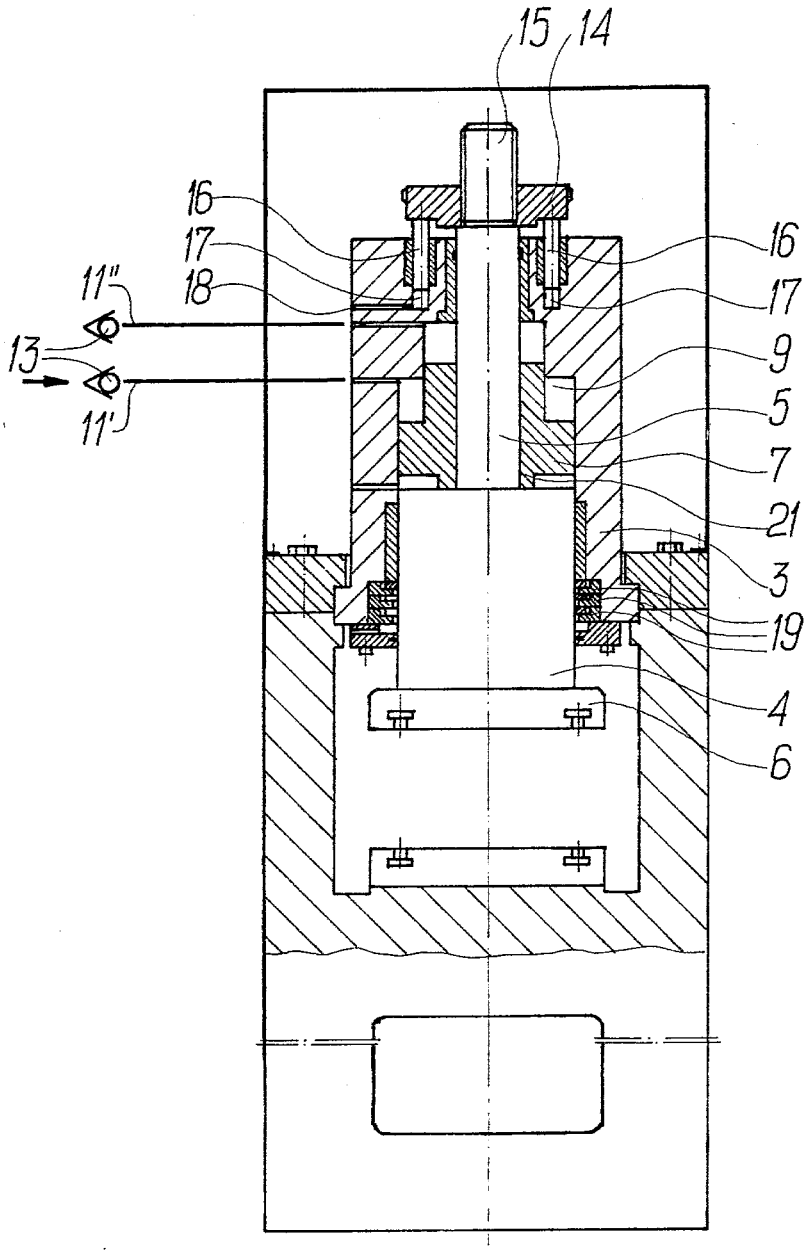
FIG. 2 and FIG. 3 are axial sections of the press at the moment of finishing the approach motion, and upon completion of the working motion, respectively.

The upper portion of the sleeve 7 slidably engages in a bore portion of the cylinder which is of reduced diameter. The sleeve and its flange form a main working chamber 10 disposed between the lower surface of the flange 8 and the upper surface of ram 4 (FIGS. 1 and 2). Preferably, as shown, the lower end of the sleeve is provided with axial projections 21 which prevent any excessive decrease in the volume of the pressure chamber 10. The outer surface of the sleeve 7 is sealed in known manner and moves relatively to the wall of the cylinder 3. The working chamber 9' and 9'' have a relatively small working area and serve for rapid approach movement of the ram towards the table 2, whereas the main working chamber 10 has a working area which is equal to that of the ram 4 and serves for use in the application of the working pressure.

As shown in FIG. 2, both chamber 9' and 9'', as well as the pressure chamber 10 are connected to an hydraulic supply circuit. Chambers 9' and 9'' are connected via suitable pipes 11' and 11'' provided with check valves 13, and chamber 10 is connected via conduit 12, which may have a supply pipe with a check valve connected thereto.

At the upper end of the cylinder, the press is fitted with a reverse motion lifting hydraulic system including a nut 14 screwed on to a threaded end portion 15 of the piston rod 5 for an adjustment of the working motion of the press, and of a system of plungers 16 mounted in chambers 17 and connected to the supply system via a conduit 18. The press has a sealing unit of the type disclosed in Polish Pat. No. 57,721, which consists of spring rings 19 mounted in the wall of the cylinder 3 and which form a stationary pack cooperating with the peripheral surface 20 of the ram 4 (See FIG. 2).

Such a sealing unit avoids the necessity for accurate machining of the cylinder, and considerably decreases the axial length of the press leading to increased rigidity, reduced weight of the press and a considerably prolonged overhaul life.

OPERATION

Figure 3:
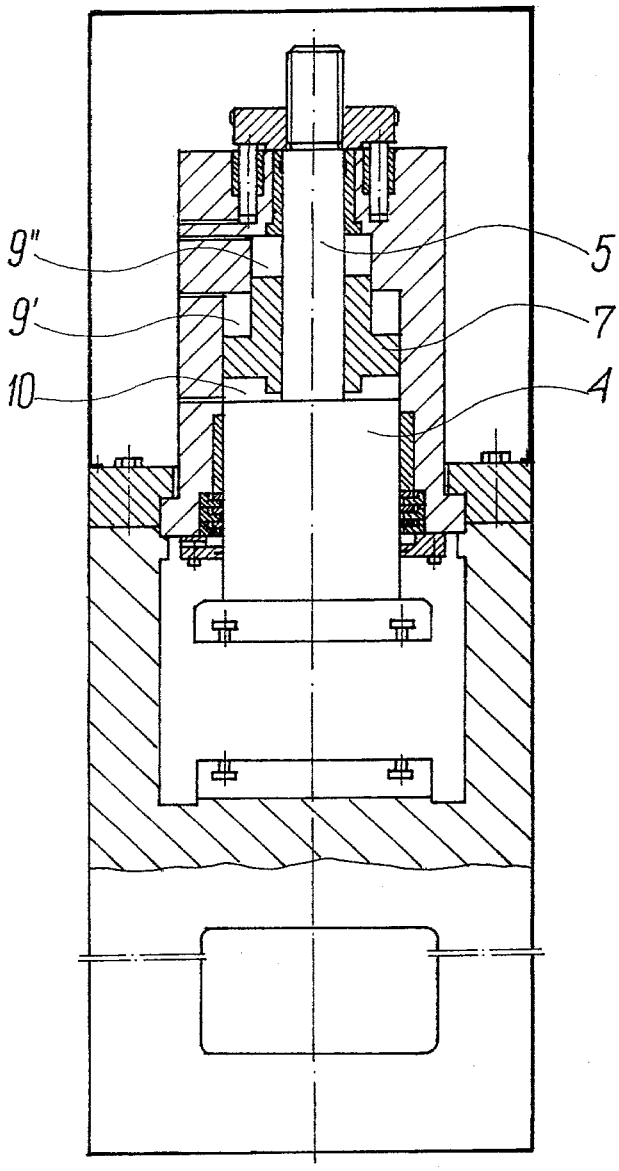

In an initial state of movement, the table 6 is rapidly moved towards the stationary table 2 by supplying hydraulic fluid through 11' and 11" to the chamber 9' or 9" with a relatively small working area (FIG. 1). As a result of pressure acting on the upper surface of the sleeve 7 in chamber 9" or upon the upper surface of the sleeve flange 8 in case of chamber 9', the piston rod 5 together with the ram 4 and movable working table 6 is moved quickly in the direction shown by arrow I, and thus a rapid approach takes place. In the final stage of this movement (FIG. 2), the exit opening of conduit 12 is uncovered as the upper end of the ram 4 passes, resulting in supply of pressurized hydraulic fluid to the main working chamber 10. This causes pressure to be exerted on the working surface of the ram 4 and an upward counterpressure in the opposite direction on oppositely facing surface of the flange 8 of sleeve 7. This leads to an automatic closing of check valve 13 and a sudden pressure rise in the chamber 9' or 9" effecting a multiplication of the pressure, and, at the same time, downward displacement of the ram 4 together with the working table 6 which perform a working movement with a considerable force exerting a pressure equal to the pressure of the hydraulic fluid multiplied by the area of the ram 4. In the final stage of the working movement (FIG. 3) during which the sleeve 7 is lifted away from its contact with ram 4, the pressure in the chamber 9' or 9" is as much higher than the pressure in the main pressure chamber 10 as much is the working area of the ram 4 greater than the working area of the sleeve 7. Owing to the obtained pressure multiplication, in the chambers 9' or 9", the surfaces of the sleeve 7 which bound the main pressure chamber 10 corresponding to the thrust faces of the ram working area, the sleeve 7 is maintained in an unchanged position irrespective of motion of the ram 4. Upon completion of this motion, the valve controlling the supply of hydraulic fluid to the main pressure chamber 10 is reset to the overflow condition by conduit 12 and, at the same time, the hydraulic fluid is supplied through conduit 18 to chamber 17. As a result of this, the plungers 16 act on nut 14 to move the piston rod 5 and thus the ram 4 and movable working table 6 to the initial position ready for commencement of another pressing operation.

Various modifications of the above-described preferred embodiment of the invention will be apparent to those skilled in the art, and it is to be understood that such modifications can be made without departing from the scope of the invention, if they are within the spirit and the tenor of the accompanying claims.

I claim:

1. In a hydraulic press comprising a ram and a hydraulic driving system for the ram, the ram including a cylinder, a piston slidably mounted in the cylinder, and a piston rod rigid with the piston, the improvement comprising:

a sleeve slidably mounted on the piston rod, said sleeve having a peripheral flange and a stem portion which sealingly engage respectively with larger and reduced diameter portions of the cylinder wall, a driving chamber of relatively small working area defined by one end of the stem portion of the sleeve and the reduced diameter portion of the cylinder wall, a working chamber of relatively large working area defined by the flange, the larger diameter portion of the cylinder wall, and the working area of the piston, and:

means for supplying pressurized liquid medium to said chambers, whereby in operation, pressurized fluid medium is supplied to said driving chamber to cause approach movement of the ram, and, towards the end of the approach movement, pressurized liquid medium is supplied to said working chamber to cause working movement of the ram and cut-off of the pressurized liquid supply to said driving chamber.

2. In a hydraulic press comprising a ram and a hydraulic driving system for the ram, the ram including a cylinder, a piston slidably mounted in the cylinder, and a piston rod rigid with the piston, the improvement comprising:

a sleeve slidably mounted on the piston rod, said sleeve having a peripheral flange and a stem portion which sealingly engage respectively with larger and reduced diameter portions of the cylinder wall, a driving chamber of relatively small working area defined by the flange, said larger diameter portion of the cylinder wall, and an annular wall of the cylinder surrounding said sleeve, a working chamber of relatively large working area defined by the flange, the larger diameter portion of the cylinder wall and the working area of the piston, and:

means for supplying pressurized liquid medium to said chambers, whereby in operation, pressurized fluid medium is supplied to said driving chamber to cause approach movement of the ram, and, towards the end of the approach movement, pressurized liquid medium is supplied to said working chamber to cause working movement of the ram and cut-off of the pressurized liquid supply to said driving chamber.

3. In a press as claimed in claim 1 or claim 2, the further improvement comprising:

two driving chambers of relatively small working area which are respectively defined by one end of the stem portion of the sleeve and the reduced diameter portion of the cylinder wall, and, by the flange, the larger diameter portion of the cylinder wall, and an annular wall of the cylinder surrounding said sleeve, and:

means for supplying pressurized liquid medium to said respective chambers.

4. In a press as claimed in claim 1 or claim 2, the further improvement comprising:

said supply of pressurized liquid medium being to said working chamber through an orifice in said larger diameter portion of the cylinder wall, which orifice is uncovered by said ram towards the end of its approach movement to communicate said orifice with said working chamber.

5. In a press as claimed in claim 3, the further improvement comprising:

a connection between each said driving chamber and a respective pressurized liquid medium supplied conduit provided with a check valve.

6. In a press as claimed in claim 3, the improvement comprising:

a supply of pressurized liquid medium common to the driving and working chambers.

7. In a press as claimed in claim 1 or claim 2, the improvement comprising:

a projection on that end of the sleeve which is directed towards the ram working area.

* * * * *